US008103179B2

(12) United States Patent
Hayashi

(10) Patent No.: US 8,103,179 B2
(45) Date of Patent: Jan. 24, 2012

(54) DEVELOPMENT DEVICE THAT OBTAINS UNIFORM TONER DENSITY OF A TWO-COMPONENT DEVELOPER

(75) Inventor: Shigeki Hayashi, Ikoma-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 225 days.

(21) Appl. No.: 12/420,238

(22) Filed: Apr. 8, 2009

(65) Prior Publication Data

US 2009/0257763 A1 Oct. 15, 2009

(30) Foreign Application Priority Data

Apr. 11, 2008 (JP) ..... 2008-103806

(51) Int. Cl.
*G03G 15/08* (2006.01)

(52) U.S. Cl. ..... 399/43; 399/53; 399/260

(58) Field of Classification Search ..... 399/43, 399/53, 58, 61, 62, 254, 256, 260
See application file for complete search history.

(56) References Cited

U.S. PATENT DOCUMENTS 6,438,344 B1 8/2002 Fujimoto

FOREIGN PATENT DOCUMENTS

| | | |
|---|---|---|
| JP | 62-217275 | 9/1987 |
| JP | 6-83195 A | 3/1994 |
| JP | 2000-66496 A | 3/2000 |
| JP | 2000-105498 A | 4/2000 |
| JP | 2008-185846 | 8/2008 |

OTHER PUBLICATIONS

Machine translation of JP 06-083195 A.*

* cited by examiner

*Primary Examiner* — David Gray
*Assistant Examiner* — Ruth LaBombard
(74) *Attorney, Agent, or Firm* — Nixon & Vanderhye P.C.

(57) ABSTRACT

A development device is provided with: a development roller that rotates while carrying a two-component developer in a development tank accommodating the two-component developer; a tubular developer conveyance path having therein a conveyance mechanism that conveys the two-component developer in an axial direction of the development roller; a developer supply mouth for supplying the two-component developer to the developer conveyance path; a developer discharge mouth for discharging the two-component developer from the developer conveyance path; a supply mouth adjustment member that adjusts the area of the opening of the developer supply mouth; and a control unit that causes the supply mouth adjustment member to operate based on the fluidity of the two-component developer in the development tank.

12 Claims, 13 Drawing Sheets

CONTROL OF CONVEYANCE OF DEVELOPER

DEVELOPMENT DEVICE THAT OBTAINS UNIFORM TONER DENSITY OF A TWO-COMPONENT DEVELOPER

CROSS-REFERENCE TO RELATED APPLICATIONS

This Nonprovisional application claims priority under 35 U.S.C. §119(a) on Patent Application No. 2008-103806 filed in Japan on Apr. 11, 2008, the entire contents of which are hereby incorporated by reference.

BACKGROUND OF THE TECHNOLOGY

1. Technical Field

The technology herein relates to a development device using a two-component developer, more specifically, to a development device that develops an electrostatic latent image on a latent image carrier such as a photoconductor drum by supplying a two-component developer thereto.

2. Description of Related Art

In an image forming apparatus using electrostatic electrophotography, generally, steps of charging, exposure, development, image transfer, cleaning, charge removal and fixing are continuously performed. In such an electrostatic electrophotographic image forming apparatus, in forming an image, for example, the surface of a photoconductor drum being rotated is uniformly charged by a charging device, and then, a laser beam is selectively applied to the charged surface of the photoconductor drum by an exposure device, thereby forming an electrostatic latent image. Then, the electrostatic latent image on the surface of the photoconductor drum is developed by a two-component developer supplied from a development device, thereby forming a toner image corresponding to the electrostatic latent image. The toner image formed on the surface of the photoconductor drum is transferred onto a recording medium by a transfer device, and then, fixed onto the recording medium by being heated by a fixing device. The residual toner remaining on the surface of the photoconductor drum is removed by a cleaning device and collected in a predetermined collection device. The cleaned surface of the photoconductor drum has its residual charge removed by a charge removal device to be ready for the next image formation.

As the developer for developing the electrostatic latent image on the surface of the photoconductor drum, a single-component developer using only toner or a two-component developer consisting of toner and carrier is generally used. The single-component developer which uses no carrier has an advantage such that the structure of the development device is simple because a stirring mechanism for uniformly mixing toner and carrier is not required. However, it has a defect such that the charging amount of the toner is not easily stabilized. On the contrary, the two-component developer is excellent in the stability of the charging amount although it requires a stirring mechanism for uniformly mixing toner and carrier. Therefore, the two-component developer is generally used for high-speed image forming apparatuses and color image forming apparatuses.

A development device using the two-component developer generally includes a development tank, a stirring member, a development roller incorporating a magnetic member, and a restricting member. The development tank rotatably supports the stirring member and the development roller, and stores therein the two-component developer consisting of toner and carrier. The development roller rotates while carrying the two-component developer in a layer on its surface. The restricting member restricts the thickness of the developer layer carried on the surface of the development roller to a predetermined thickness to thereby supply a fixed amount of two-component developer to the surface of the photoconductor drum. The stirring member conveys the two-component developer toward the development roller while uniformly stirring it so that the mixture ratio (toner density) between toner and carrier in the development tank is constant.

However, when a multiplicity of document images where the image density is uneven are continuously printed, since the toner in the development tank is locally consumed, the toner density becomes uneven in the axial direction of the development roller. With respect to this problem, for example, Japanese Patent Application Laid-Open No. S62-217275 (1987) discloses a development device provided with a tubular developer conveyance path having therein a conveyance screw that conveys the two-component developer in the axial direction of the development roller in order to eliminate the toner density unevenness by uniformly dispersing the two-component developer in the development tank.

SUMMARY OF THE TECHNOLOGY

In recent years, to deal with printing speed enhancement, color printing and power consumption reduction, in the two-component developer, the particle diameter and softening point of toner have been decreasing and the particle diameter of carrier has been decreasing. Such a two-component developer containing toner and carrier has a problem in that when it is stirred for a long time in the development tank, because of frictional heat and pressure (stress), the external additive on the toner surface is buried in the carrier surface and the wax in the toner adheres to the carrier surface (filming), whereby the fluidity of the two-component developer is readily decreased (deteriorated).

In particular, in the development device described in Japanese Patent Application Laid-Open No. S62-217275 (1987), if the fluidity of the two-component developer is changed (decreased), since the amount of two-component developer conveyed by the conveyance screw is decreased, it is difficult to make the toner density in the development tank uniform when a multiplicity of document images where the image density is uneven are continuously printed. When the amount of two-component developer conveyed by the conveyance screw is previously set to a slightly larger amount based on a prediction that the fluidity decreases with use, the stress due to the conveyance by the conveyance screw increases and this accelerates the decrease (deterioration) in the fluidity of the two-component developer.

The technology herein is made in view of the above-mentioned circumstances, and an object thereof is to provide a development device capable of suppressing the deterioration of the two-component developer by controlling the amount of conveyance by the tubular developer conveyance path in the development tank according to the condition, characteristic and the like of the two-component developer in the development tank, and uniformizing the toner density of the two-component developer in the development tank even when the two-component developer is deteriorated.

A development device according to a first aspect is provided with: a development roller that rotates while carrying a two-component developer in a development tank accommodating the two-component developer; a tubular developer conveyance path having therein a conveyance mechanism that conveys the two-component developer in an axial direction of the development roller; a developer supply mouth for supplying the two-component developer to the developer conveyance path; and a developer discharge mouth for discharging the two-component developer from the developer conveyance path. In the development device, the following are provided: a supply mouth adjustment member that adjusts the area of the opening of the developer supply mouth; and control means for causing the supply mouth adjustment member to operate based on information on the two-component developer in the development tank.

According to the first aspect, by adjusting, based on the fluidity of the two-component developer in the development tank, the area of the opening of the developer supply mouth for supplying developer to the tubular developer conveyance path that conveys the two-component developer in the axial direction of the development roller, the amount of supply of the two-component developer to the tubular developer conveyance path is adjusted, thereby controlling the amount of conveyance by the tubular developer conveyance path. When the condition, characteristic and the like of the two-component developer in the development tank are normal, by decreasing the area of the opening of the developer supply mouth so that the supply amount does not increase, the deterioration of the two-component developer caused at the time of conveyance by the conveyance mechanism in the tubular developer conveyance path is minimized. On the other hand, when the condition, characteristic and the like of the two-component developer in the development tank are deteriorated, by increasing the area of the opening of the developer supply mouth so that the supply amount increases, the reduction in the conveyance amount of the two-component developer conveyed by the tubular developer conveyance path is suppressed, so that the toner density of the two-component developer in the development tank can be made uniform.

In a development device according to a second aspect, in the first aspect, the control means increases the area of the opening of the developer supply mouth as the cumulative use time of the two-component developer increases.

According to the second aspect, the reduction in the fluidity of the two-component developer in the development tank is determined based on the cumulative use time, and adjustment is made so that when the cumulative use time of the two-component developer is short, the area of the opening of the developer supply mouth for supplying developer to the tubular developer conveyance path is decreased and the area of the opening of the developer supply mouth for supplying developer to the tubular developer conveyance path is increased as the cumulative use time increases. Consequently, without the use of complicated measurement means associated with the two-component developer in the development tank, the deterioration of the two-component developer is minimized and the reduction in the conveyance amount of the two-component developer conveyed by the tubular developer conveyance path is suppressed, whereby the toner density can be made uniform.

In a development device according to a third aspect, in the second aspect, the control means determines the cumulative use time of the two-component developer based on the number of times an electrostatic latent image on a latent image carrier is developed.

According to the third aspect, the cumulative use time of the two-component developer is determined based on the number of times the electrostatic latent image on the latent image carrier is developed. Consequently, the deterioration of the two-component developer in the development tank can be appropriately determined by simple means such as a simple counter that counts the number of times of development and stores it without the use of a complicated timer or the like.

In a development device according to a fourth aspect, in the first aspect, detection means is provided for detecting the fluidity of the two-component developer in the development tank, and the control means controls the area of the opening of the developer supply mouth based on the fluidity of the two-component developer detected by the detection means. Specifically, when the detected fluidity of the two-component developer is higher than a predetermined level, the control means decreases the area of the opening of the developer supply mouth, and when the detected fluidity of the two-component developer is lower than the predetermined level, the control means increases the area of the opening of the developer supply mouth.

According to the fourth aspect, when the detected fluidity of the two-component developer in the development tank is high, by decreasing the supply amount by decreasing the area of the opening of the developer supply mouth, the deterioration of the two-component developer caused at the time of conveyance by the conveyance mechanism in the tubular developer conveyance path is minimized. On the other hand, when the detected fluidity of the two-component developer in the development tank is low, by increasing the supply amount by increasing the area of the opening of the developer supply mouth, the reduction in the conveyance amount of the two-component developer conveyed by the tubular developer conveyance path is suppressed, whereby the toner density of the two-component developer in the development tank can be made uniform.

In a development device according to a fifth aspect, in the first to fourth aspects, the developer supply mouth and the developer discharge mouth are provided at one end and at the other end in the axial direction of the development roller, respectively.

According to the fifth aspect, the two-component developer is supplied into the tubular developer conveyance path from the developer supply mouth provided at one end in the axial direction of the development roller, and the two-component developer conveyed in the tubular developer conveyance path is discharged out of the developer conveyance path from the developer discharge mouth provided at the other end in the axial direction of the development roller. Consequently, the conveyance convection of the two-component developer in the axial direction of the development roller can be most effectively caused, and even when an electrostatic latent image of an image such that toner is locally consumed is continuously developed onto a multiplicity of sheets, the unevenness of the toner density can be suppressed.

In a development device according to a six aspect, in the first to fourth aspects, a restricting member that restricts the amount of two-component developer carried by the development roller and a flow plate that lets an excessive two-component developer restricted by the restricting member flow in a direction away from the peripheral surface of the development roller are provided in the development tank, the developer conveyance path is provided on the bottom side of the flow plate, and the developer supply mouth is formed on the flow plate.

According to the sixth aspect, since the excessive two-component developer to which the amount of two-component developer carried by the development roller is restricted by the restricting member is supplied into the developer conveyance path provided on the bottom side of the flow plate from the developer supply mouth formed on the flow plate while flowing on the flow plate in the direction away from the peripheral surface of the development roller, by changing the area of the opening of the developer supply mouth, the amount of supply of the two-component developer to the developer conveyance path can be accurately controlled.

According to the development device of the present technology, a development device is provided in which by controlling the amount of conveyance by the tubular developer conveyance path in the development tank according to the condition, characteristic and the like of the two-component developer in the development tank, the deterioration such as the reduction in the fluidity of the two-component developer is suppressed and even when the two-component developer is deteriorated, the toner density of the two-component developer in the development tank can be made uniform.

Moreover, by using the development device according to the present technology for the development of a latent image carrier in an image forming apparatus, even when an electrostatic latent image of an image where the image density is uneven in the axial direction of the development roller is continuously developed onto a plurality of sheets, stable images where the image density unevenness is suppressed are obtained.

The above and further objects and features will more fully be apparent from the following detailed description with accompanying drawings.

DETAILED DESCRIPTION OF THE TECHNOLOGY

Hereinafter, embodiments in which the development device is applied to an electrostatic electrophotographic image forming apparatus will be described with reference to the drawings.

Figure 1:
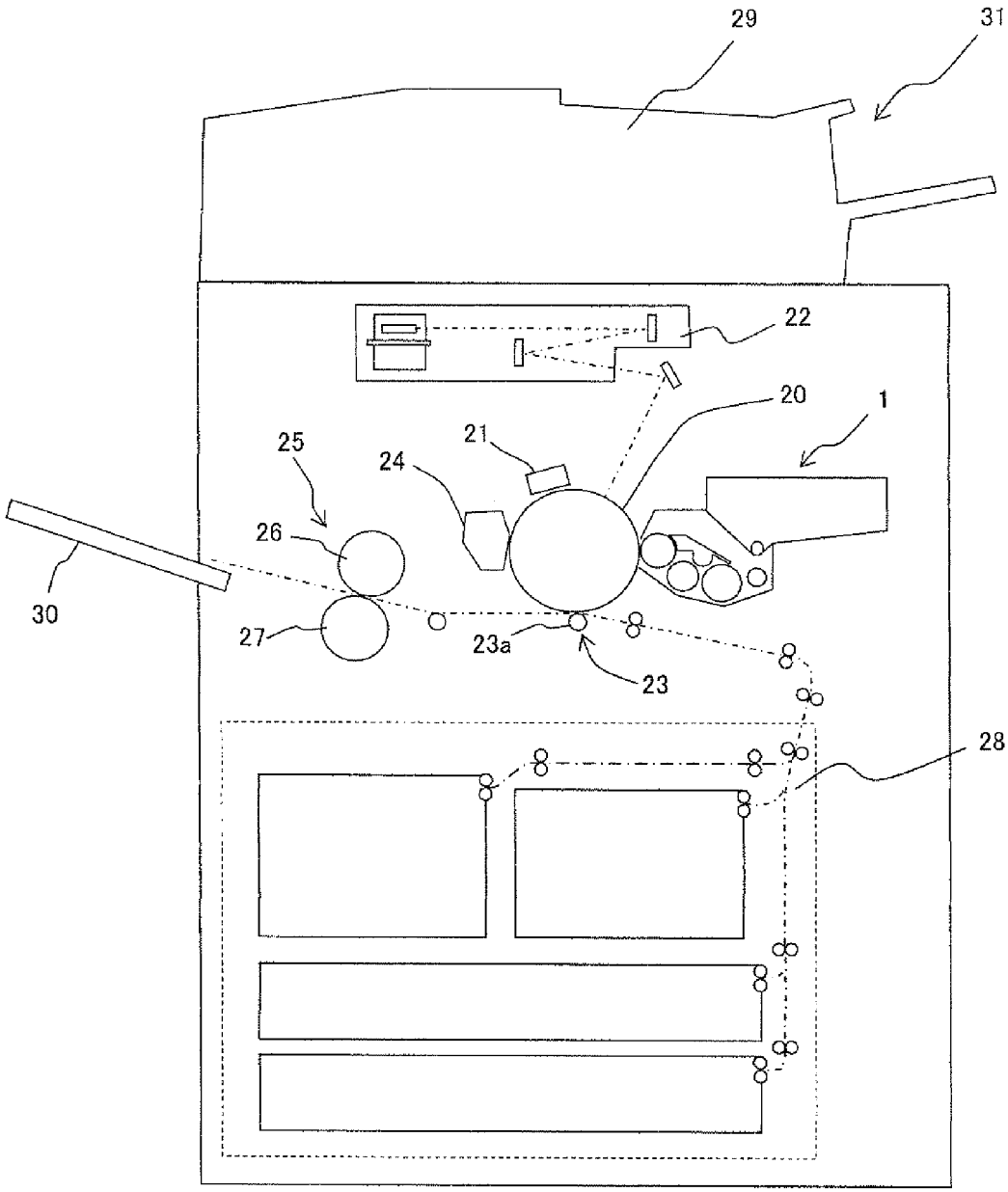
FIG. 1 is a front cross-sectional view schematically showing the general structure of an image forming apparatus incorporating a development device.

FIG. 1 is a front cross-sectional view schematically showing the general structure of an image forming apparatus incorporating the development device. An image forming apparatus 31 is a digital copier that prints, in accordance with the image information of a document read by a scanner unit 29 or the image information transmitted through a network, an image corresponding to the image information.

The image forming apparatus 31 has: a photoconductor drum 20; a charging device 21 that charges the surface of the photoconductor drum 20; an exposure device 22 that forms an electrostatic latent image on the surface of the photoconductor drum 20; a development device 1 that forms a toner image by supplying toner to the electrostatic latent image formed on the surface of the photoconductor drum 20; a transfer device 23 that transfers the toner image formed on the surface of the photoconductor drum 20, onto a recording medium; a cleaning device 24 that cleans the surface of the photoconductor drum 20 from which the toner image has been transferred; a fixing device 25 that fixes the transferred toner image to the recording medium; a paper feed tray 28 that holds recording media such as recording sheets; the scanner unit 29 that reads the image information of a document; and a paper discharge tray 30 into which printed recording media where image formation has been performed are discharged.

The photoconductor drum 20 is a roller-form member that is held so as to be rotatable about the axis line by non-illustrated drive means in the casing of the image forming apparatus 31 and has on its surface a photosensitive film where the electrostatic latent image corresponding to the image and the toner image into which the electrostatic image is developed are formed. As the photoconductor drum 20, for example, one where a photosensitive film is formed on the surface of a cylindrical conductive base may be used. Examples of the photosensitive film include an organic photosensitive film and an inorganic photosensitive film. Examples of the organic photosensitive film includes: a laminated film of a charge generation layer which is a resin layer containing a charge generation material and a charge transport layer which is a resin layer containing a charge transport material; and a single-layer film containing a charge generation material and a charge transport material in one resin layer. Examples of the inorganic photosensitive file include a film containing one or two kinds selected from among zinc oxide, selenium, amorphous silicon and the like. An underlayer film may be interposed between the conductive base and the photosensitive film. A protective film for protecting the photosensitive film may be provided around the surface of the photosensitive film.

The charging device 21 to which a voltage is applied from a non-illustrated power source charges the surface of the photoconductor drum 20 to a predetermined polarity and potential. While a charger-type charging device is used in the present embodiment, the technology is not limited thereto; a charging device such as a charging-brush-type charging device, a roller-form charging device, a sawtooth-type charging device and a magnetic brush may be used as the charging device 21.

To the exposure device 22, the image information of a document read by the scanner unit 29 or the image information transmitted from an external apparatus is inputted, and signal light corresponding to the image information is applied to the surface of the photoconductor drum 20 being charged. Thereby, an electrostatic latent image corresponding to the image information is formed on the surface of the photoconductor drum 20. As the exposure device 22, an optical scanner including a light source is used. The optical scanner is, for example, a device constituted by a combination of a light source, a polygon mirror, an fθlens, a reflecting mirror and the like. As the light source, for example, a semiconductor laser, an LED array, an electroluminescence (EL) element or the like may be used.

The development device 1 develops the electrostatic latent image with toner by supplying a two-component developer to the surface of the photoconductor drum 20. Its structure and operation will be described later in detail.

The transfer device 23 is rotatably provided in the casing of the image forming apparatus 31, and has a transfer roller 23*a* disposed so as to be pressed against the photoconductor drum 20 through a recording medium. As the transfer roller 23*a*, for example, a roller-form member is used where a conductive elastic layer is formed on the surface of a metal core with a diameter of 8 to 10 mm. As the metal of which the metal core is made, stainless steel, aluminum or the like may be used. As the conductive elastic layer, a rubber material may be used where a conductive material such as carbon black is mixed in a rubber material such as ethylene-propylene rubber (EPDM), foamed EPDM or urethane foam.

Recording media are supplied one by one from the paper feed tray 28 to the position (transfer nip position) where the transfer roller 23*a* is pressed against the photoconductor drum 20 through a non-illustrated pickup roller and resist roller in synchronism with the conveyance of the toner image developed on the photoconductor drum 20 by the rotation of the photoconductor drum 20, and when the recording media passes through the transfer nip position, the toner image on the surface of the photoconductor drum 20 is transferred onto the recording media. To the metal core of the transfer roller 23*a*, a non-illustrated power source is connected, and when the toner image is transferred onto a recording medium, a voltage of a polarity opposite to the charging polarity of the toner constituting the toner image is applied to the transfer roller 23*a*, whereby the toner image on the surface of the photoconductor drum 20 is smoothly transferred onto the recording medium.

The cleaning device 24 has a non-illustrated cleaning blade and toner reservoir. The cleaning blade is a rectangular plate-form elastic member provided so as to extend parallelly in the direction of length of the photoconductor drum 20, and is attached so that one of the opposing long sides abuts against the surface of the photoconductor drum 20 and the other long side is along an opening of the toner reservoir. The cleaning blade removes the toner, paper powder and the like remaining on the surface of the photoconductor drum 20 after the toner image is transferred onto the recording medium. The toner reservoir is a container-form member having an internal space, and the toner removed by the cleaning blade is directed from the opening and temporarily stored in the toner reservoir. The surface of the photoconductor drum 20 from which the toner image has been transferred is cleaned by such a cleaning device 24.

The fixing device 25 has a fixing roller 26 and a pressurizing roller 27. The fixing roller 26 is a roller-form member rotatably provided in the casing of the image forming apparatus 31. The fixing roller 26 includes a non-illustrated heating member, and fuses, by heating, the unfixed toner on the recording medium conveyed from the transfer nip position to fix it to the recording medium. As the fixing roller 26, for example, a roller-form member whose metal core is covered with an elastic layer may be used. The metal core is made of a metallic material such as iron, stainless steel or aluminum. The elastic layer is made of an elastic material such as silicone rubber or fluororubber. The heating member generates heat by being subjected to voltage application from a non-illustrated power source. As the heating member, for example, a halogen lamp or an infrared lamp may be used.

The pressurizing roller 27 is a roller-form member that is provided so as to be rotatable and is disposed so as to be pressed against the fixing roller 26 by a non-illustrated pressurizing member. The pressurizing roller 27 rotates with the rotation of the fixing roller 26. The position where the fixing roller 26 and the pressurizing roller 27 are pressed against each other is a fixing nip position. In the heat fixing of the toner image to the recording medium by the fixing roller 26, the pressurizing roller 27 presses the fused toner against the recording medium to thereby promote the fixing of the toner image to the recording medium. As the pressurizing roller 27, a roller-form member having the same structure as the fixing roller 26 may be used, and a heating member may be provided therein. As the heating member, one similar to the heating member in the fixing roller 26 may be used. The recording medium having passed through the fixing nip position of the fixing device 25 and having the toner image fixed thereto is discharged onto the paper discharge tray 30 by a non-illustrated conveyance roller.

The paper feed tray 28 is a tray holding recording media such as plain paper, coated paper, color copy paper and OHP films. More than one paper feed tray 28 is provided, and recording media of a different size is held in each paper feed tray 28. Examples of the recording medium size include A3, A4, B5 and B4. The same size of recording media may be held in a plurality of paper feed trays 28.

The scanner unit 29 has a non-illustrated document set tray, a reversing automatic document feeder (RADF) and a document reader. The reversing automatic document feeder conveys a document placed on the document set tray, to a document stand of the document reader. The document reader has the document stand and a document scanner. The document stand is a plate-form glass member on which the document whose image information is to be read is placed.

The document scanner includes: a lamp unit including a non-illustrated light source and a first reflecting mirror; a mirror unit including a second reflecting mirror and a third reflecting mirror; an optical lens; and a line sensor. The line sensor is constituted by photoelectric conversion elements (for example, charge coupled devices) arranged in rows.

In the case of a stationary document reading method in which the image of the document placed on the document stand is read, the lamp unit emits light to the document placed on the document stand while reciprocating at a constant speed V parallelly to the lower surface of the document stand along the lower surface, and the mirror unit reciprocates at a speed of V/2 with the reciprocation of the lamp unit. Consequently, the first reflecting mirror reflects the light image reflected from the image formed surface of the document on the document stand, to the second reflecting mirror, the second reflecting mirror reflects the reflected light image to the third reflecting mirror, the third reflecting mirror reflects the reflected light image to the optical lens, the optical lens focuses the reflected light image reflected by the third reflecting mirror on the line sensor, and the image information of the document placed on the document stand is read line by line.

On the contrary, in the case of a moving document reading method in which the document is automatically conveyed to the document stand by using the reversing automatic document feeder and the image of the document is read, the lamp unit and the mirror unit are stationary in their respective home positions, light is emitted to the document passing the document stand, the light image reflected from the document is reflected to the optical lens by way of the first, second and third reflecting mirrors, the optical lens focuses the received reflected light image on the line sensor, and the image information of the document passing the document stand is read line by line.

The line sensor has a non-illustrated CCD circuit that photoelectrically converts the reflected light image focused by the optical lens, into an electric signal, and outputs the electric signal which is the image information, to a non-illustrated image processor. The image processor converts the image information inputted from the document reader or an external apparatus, into an electric signal, and outputs it to the exposure device 22.

Figure 2:
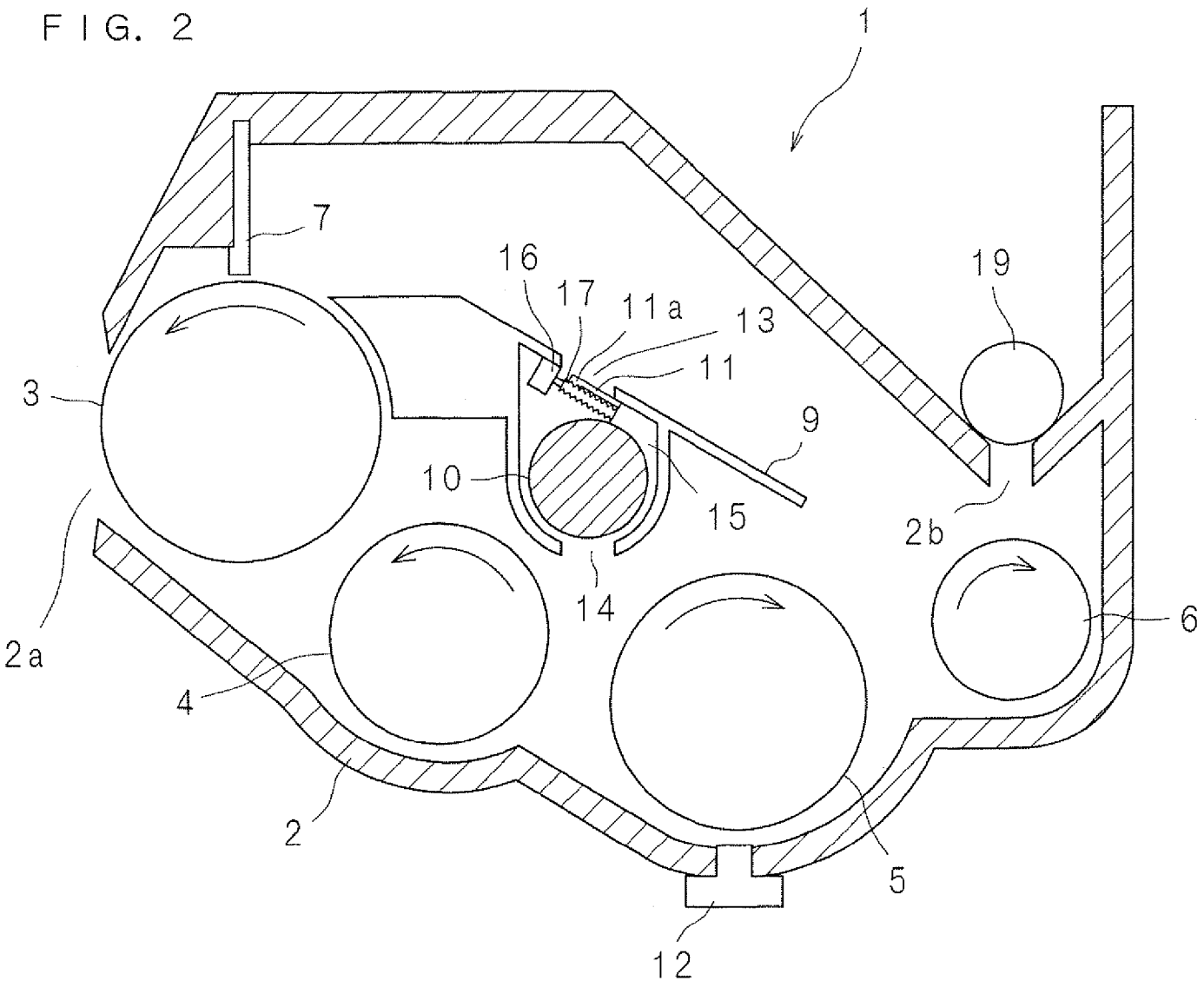
FIG. 2 is a front cross-sectional view showing the structure of the development device (in a condition where the area of the opening of a developer supply mouth is minimum)
Figure 3:
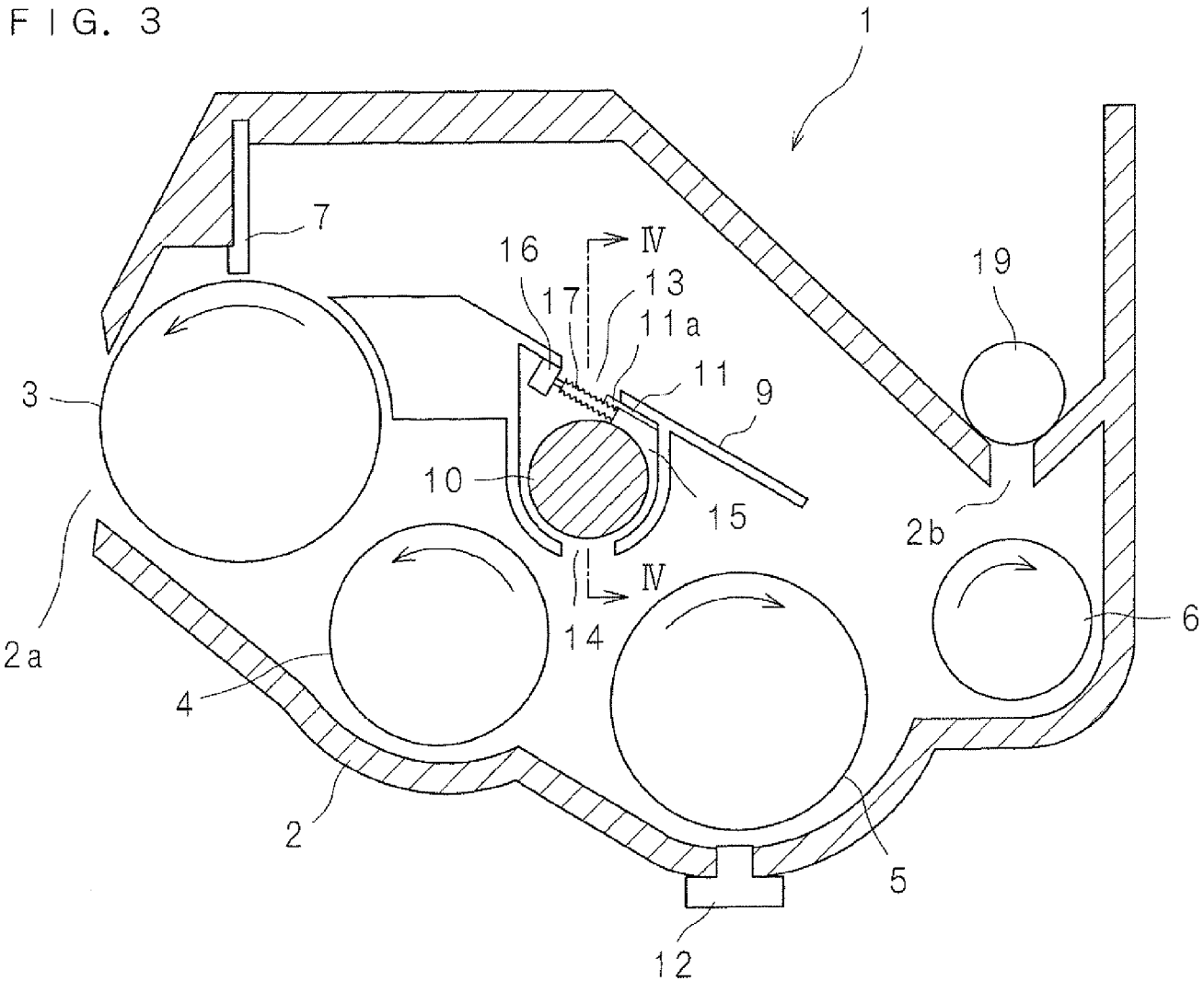
FIG. 3 is a front cross-sectional view showing the structure of the development device (in a condition where the area of the opening of the developer supply mouth is maximum)
Figure 4:
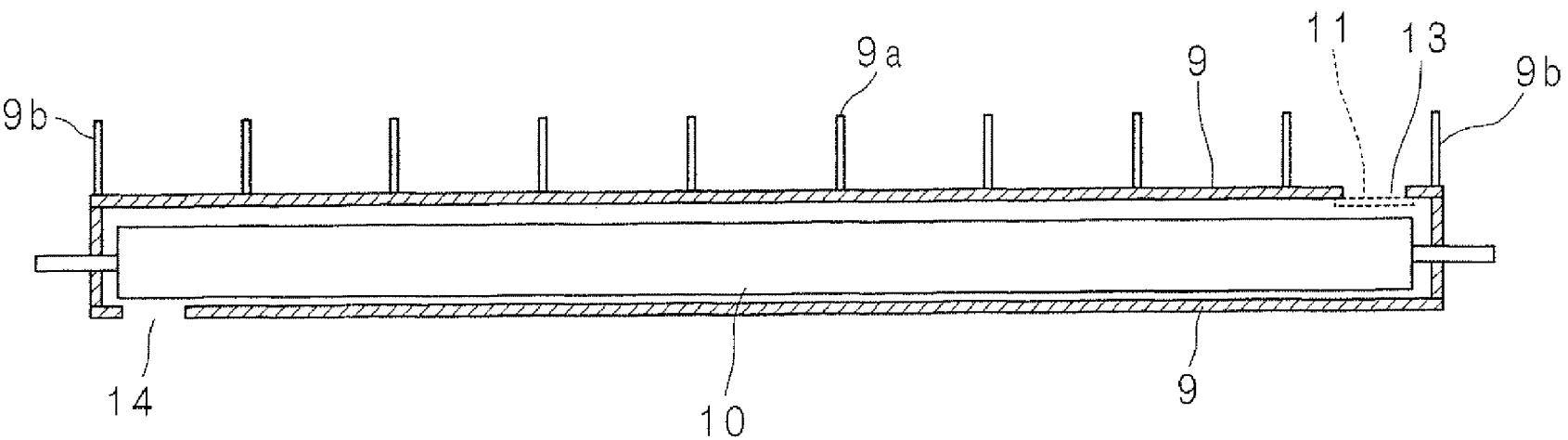
FIG. 4 is a cross-sectional view taken along line IV-IV of FIG. 3.
Figure 5:
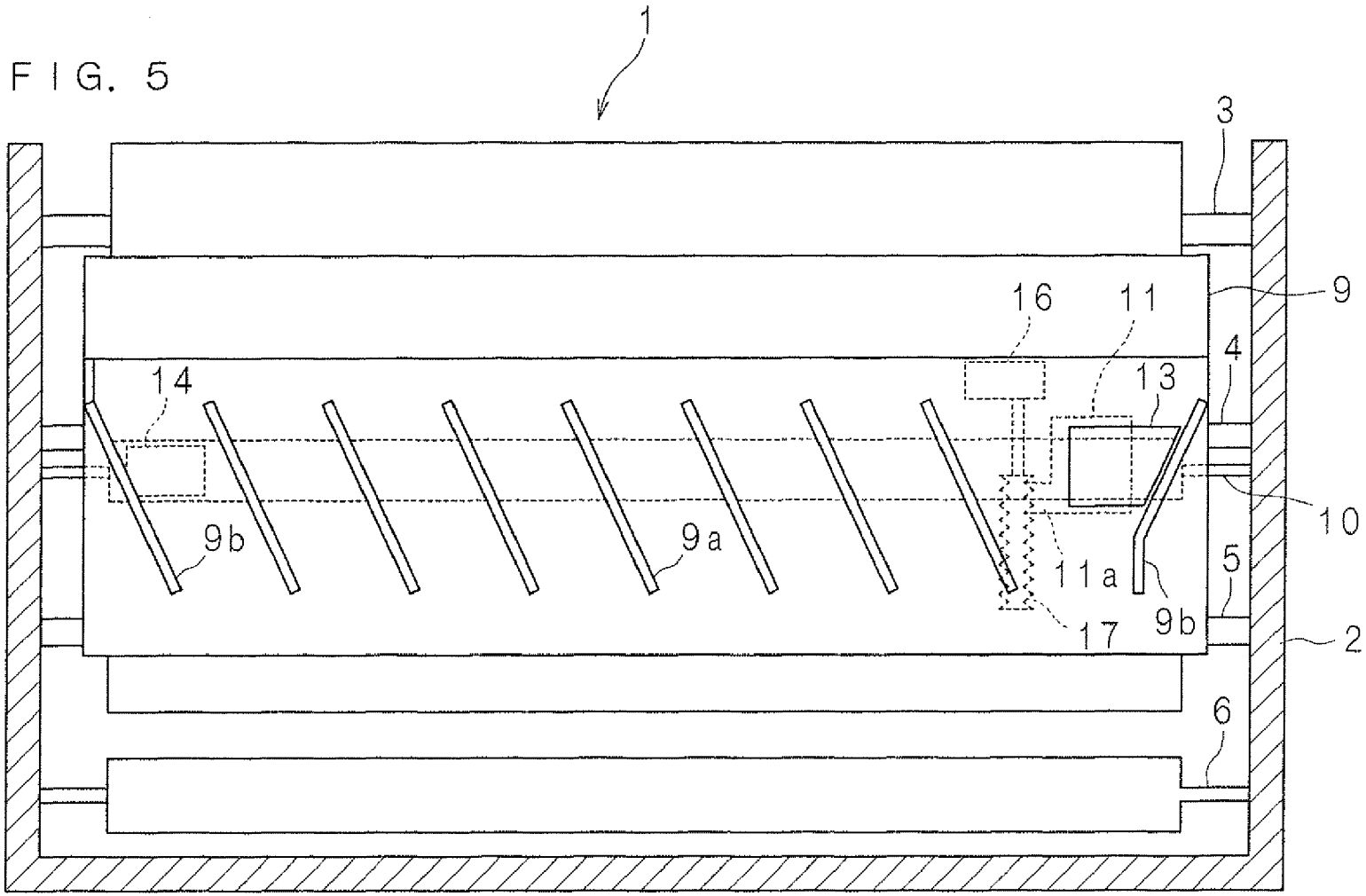
FIG. 5 is a top plan view showing the inside of a development tank in a condition where the upper lid of the development tank is removed (in a condition where the area of the opening of the developer supply mouth is minimum)
Figure 6:
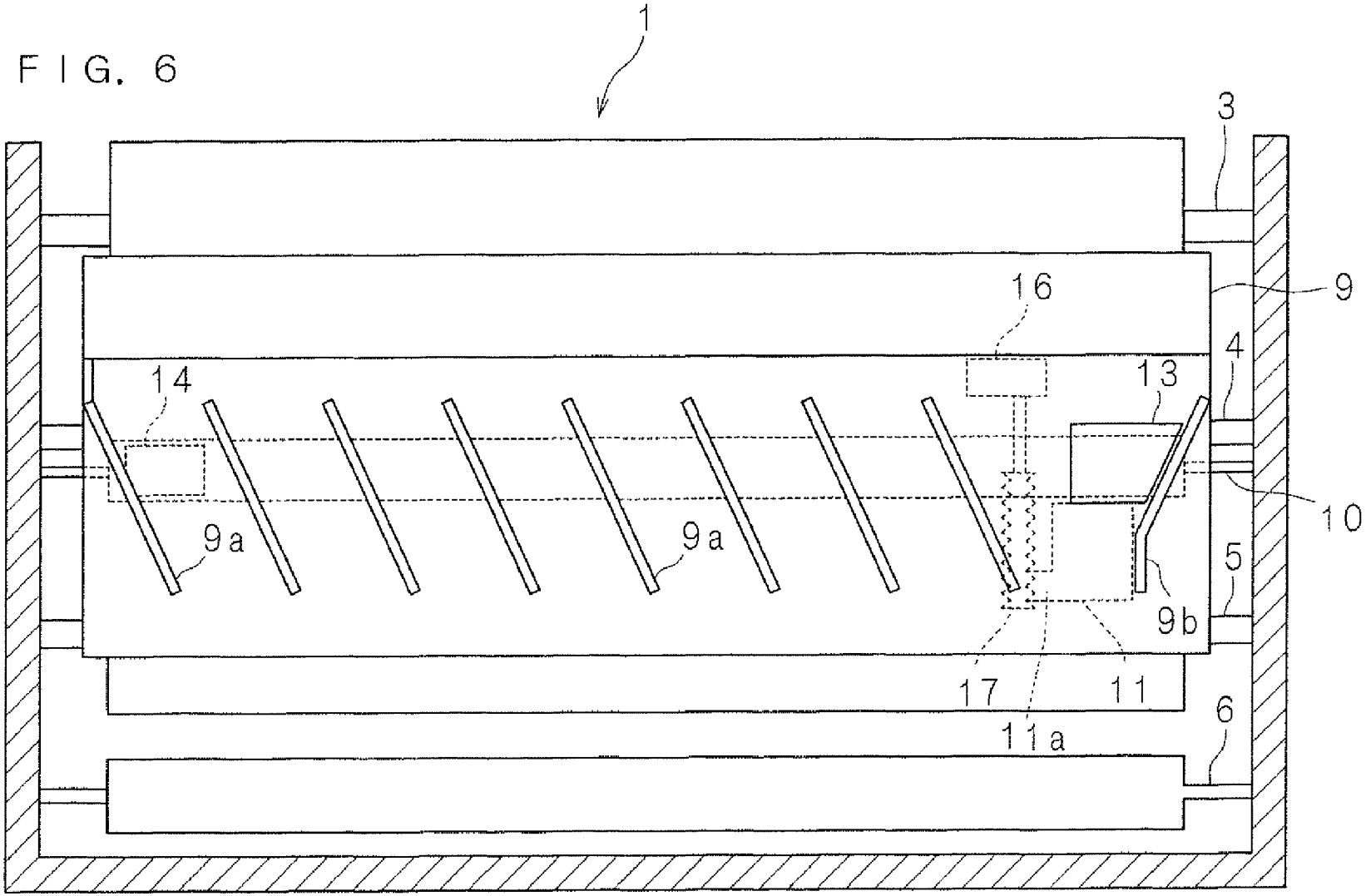
FIG. 6 is a top plan view showing the inside of the development tank in a condition where the upper lid of the development tank is removed (in a condition where the area of the opening of the developer supply mouth is maximum)
Figure 7A:
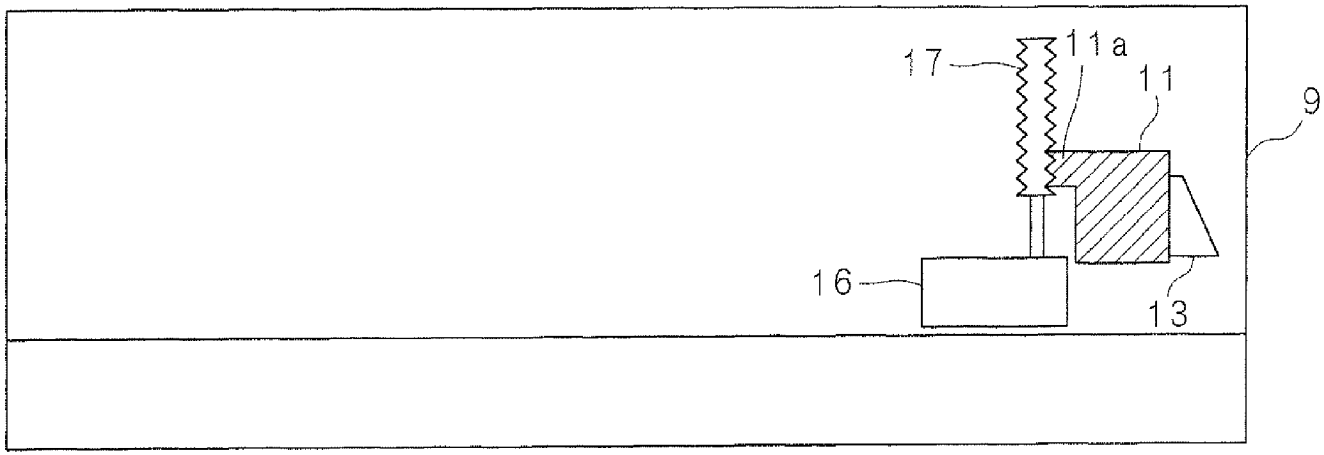
FIG. 7A is a bottom plan view of a flow plate in FIG. 5 viewed from the bottom side.
Figure 7B:
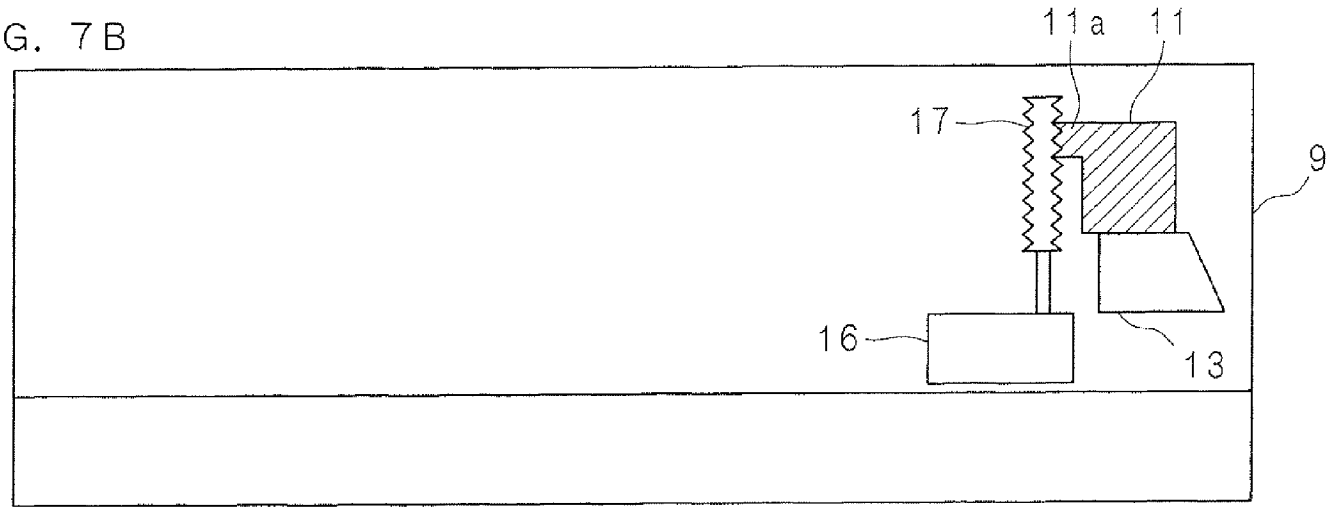
FIG. 7B is a bottom plan view of the flow plate in FIG. 6 viewed from the bottom side.

Next, a first embodiment of the development device 1 will be described. FIGS. 2 and 3 are front cross-sectional views showing the structure of the development device 1. FIG. 2 shows a condition where the area of the opening of a developer supply mouth is minimum. FIG. 3 shows a condition where the area of the opening of the developer supply mouth is maximum. FIG. 4 is a cross-sectional view taken along line IV-IV of FIG. 3. FIGS. 5 and 6 are top plan views showing the inside of a development tank in a condition where the upper lid of the development tank is removed. FIG. 5 shows a condition where the area of the opening of the developer supply mouth is minimum. FIG. 6 shows a condition where the area of the developer supply opening is maximum. FIGS. 7A and 7B are bottom plan views of a flow plate in FIGS. 5 and 6 viewed from the bottom side. FIG. 7A corresponds to FIG. 5, and FIG. 7B corresponds to FIG. 6.

The development device 1 has a development tank 2 accommodating a two-component developer consisting of toner and carrier. The development tank 2 is a tubular container member that is elongated in the direction parallel to the axial direction of the photoconductor drum 20 and has an opening 2*a* formed in a position opposed to the photoconductor drum 20. The toner is, for example, a polyester toner with a mean volume particle diameter of 6.5 μm and a softening temperature of about 115° C. The carrier is, for example, a silicone-resin-coated ferrite carrier with a mean volume particle diameter of 45 μm.

In the development tank 2, a development roller 3 rotating while carrying the two-component developer in a layer, a first stirring member 4, a second stirring member 5 and a third stirring member 6 are provided so as to be rotatable about the axis by non-illustrated drive means. The development roller 3 is disposed parallel to the photoconductor drum 20 at an interval therefrom, and is opposed to the photoconductor drum 20 through the opening 2*a*. The development roller 3 is a roller for supplying the two-component developer to the electrostatic latent image formed on the surface of the photoconductor drum 20. For the development roller 3, a structure may be used in which magnetic field generation means such as a magnet roll that generates a magnetic field of a plurality of poles is accommodated in a hollow cylinder (sleeve) made of non-magnetic stainless steel or aluminum.

The stirring members 4, 5 and 6 are disposed parallel to the development roller 3. The first stirring member 4 is provided in a position opposed to the photoconductor drum 20 through the development roller 3 and below the development roller 3 in the vertical direction. The second stirring member 5 is provided in a position opposed to the development roller 3 through the first stirring member 4 and below the development roller 3 in the vertical direction. The third stirring member 6 is provided in a position opposed to the first stirring member 4 through the second stirring member 5 and below a later-described toner supply mouth 2*b* in the vertical direction. The first stirring member 4 rotates counterclockwise. The second stirring member 5 and the third stirring member 6 rotate clockwise.

Further, in the development tank 2, the following are provided: a restricting member 7 that adjusts the conveyance amount of the developer by restricting the amount of two-component developer carried by the development roller 3; and a flow plate 9 that catches the excessive two-component developer restricted by the restricting member 7 and returned toward the upstream side in the rotation direction of the development roller 3 and lets it flow in the direction away from the peripheral surface of the development roller 3 to return it to an upper portion of the second stirring member 5. The restricting member 7 also acts to charge the insufficiently charged developer contained in the developer layer by the friction with the developer layer.

The restricting member 7 is an elongate plate-form member extending in the direction of length of the development roller 3, and its plate surface is situated on the extension line in the direction of radius of the development roller 3. The restricting member 7 is fixed to the upper wall near the upper rim of the opening 2*a* of the development tank 2 so as to be opposed to the peripheral surface of the development roller 3 at a distance of approximately 0.3 to 2 mm therefrom. The restricting member 7 may be made of, for example, a non-magnetic metal such as stainless steel or aluminum, or a synthetic resin. In the present embodiment, a thin-plate-form stainless steel is used.

The flow plate 9 is a rectangular plate-form member elongated in the axial direction of the development roller 3. In the development tank 2, the flow plate 9 is provided above the first stirring member 4 and the second stirring member 5 in the vertical direction so as to be situated on the upstream side of the restricting member 7 in the rotation direction of the development roller 3. The flow plate 9 has an upper part in which one end side in the direction of the short side is horizontally formed and opposed to the surface of the development roller 3 at a distance therefrom and a slanting part that becomes lower as it extends toward the other end side in a direction away from the development roller 3. On the upper surface of the slanting part of the flow plate 9, a plurality of direction changing plates 9*a* that change the direction of flow of the two-component developer and a side plate 9*b* that prevents the two-component developer from dropping to the lateral side are provided in a state of standing in the vertical direction. The flow plate 9 is made of, for example, non-magnetic stainless steel or aluminum, or a synthetic resin.

The toner supply mouth 2*b* is formed in the upper wall of the development tank 2 above the third stirring member 6, and a toner hopper is provided above the development tank 2. The toner hopper has a toner supply roller 19 rotatably provided so as to be situated over the toner supply mouth 2*b* in the vertical direction. On the bottom surface of the development tank 2 under the second stirring member 5, a toner density detection sensor 12 whose sensor surface is exposed into the development tank 2 is provided. The toner supply roller 19 is driven based on the result of the detection by the toner density detection sensor 12, and toner is supplied into the development tank 2 through the toner supply mouth 2*b* by the rotation of the toner supply roller 19.

The toner supplied into the development tank 2 through the toner supply mouth 2*b* is conveyed to the second stirring member 5 by the rotation of the third stirring member 6. The second stirring member 5 stirs and mixes the newly supplied toner into the two-component developer where the toner density is low, and conveys it to the first stirring member 4. The first stirring member 4 brings the two-component developer conveyed from the second stirring member 5, up to the development roller 3 while further stirring and mixing it. Consequently, a uniform charge is applied to the toner of the two-component developer stored in the development tank 2 by the stirring and mixing by the first stirring member 4 and the second stirring member 5, and the charged two-component developer is brought up to be supplied to the periphery of the development roller 3.

The layer thickness of the two-component developer carried by the development roller 3 is restricted by the restricting member 7 provided near the upper rim of the opening 2*a*. While being carried by the development roller 3, the two-component developer having passed through the gap between the development roller 3 and the restricting member 7 is conveyed to a development nip position opposed so as to be nearest to the surface of the photoconductor drum 20. At the development nip position, the charged toner in the two-component developer flies to adhere to the electrostatic latent image on the surface of the photoconductor drum 20 by the electrostatic force, whereby a toner image is formed on the surface of the photoconductor drum 20. In this case, a development bias voltage is applied to the development roller 3 from a non-illustrated power source to promote development. Then, the two-component developer carried on the surface of the development roller 3 is returned to the development tank 2. On the other hand, the excessive two-component developer restricted by the restricting member 7 is reversed by the restricting member 7 to be returned to the upstream side in the rotation direction of the development roller 3, flows down on the flow plate 9, and then, is returned to the upper portion of the second stirring member 5.

Under the flow plate 9, a substantially cylindrical developer conveyance path 15 is provided parallel to the development roller 3, and in the developer conveyance path 15, a conveyance screw 10 is disposed so that its axial direction is parallel to the cylinder axial direction. A developer supply mouth 13 having a trapezoidal opening for directing the two-component developer into the developer conveyance path 15 is provided on the flow plate 9 on one end side of the developer conveyance path 15. A developer discharge mouth 14 having a rectangular opening for discharging the two-component developer to the space between the first stirring member 4 and the second stirring member 5 from above is provided at the bottom of the other end, opposite to the developer supply mouth 13, of the developer conveyance path 15. By the rotation of the conveyance screw 10, the two-component developer directed from the developer supply mouth 13 into the developer conveyance path 15 is conveyed along the axial direction and discharged from the developer discharge mouth 14.

As shown in FIGS. 7A and 7B, a supply mouth adjustment member 11 supported by non-illustrated slide support means such as a rail so as to be slidable in a direction orthogonal to the direction of length of the developer conveyance path 15 is provided on the bottom side of the flow plate 9. A drive motor 16 and a drive screw 17 connected to the rotation shaft of the drive motor 16 are attached to the bottom surface of the flow plate 9. A gear portion 11*a* provided on an end of the supply mouth adjustment member 11 is disposed so as to engage with the drive screw 17. By rotating the drive motor 16 normally or in reverse, the drive screw 17 is rotated to slide the supply mouth adjustment member 11, thereby adjusting the area of the opening of the developer supply mouth 13. FIGS. 2 and 5 show the case where the opening of the developer supply mouth 13 is adjusted to the minimum area. FIGS. 3 and 6 show the case were the opening of the developer supply mouth 13 is adjusted to the maximum area.

Figure 8:
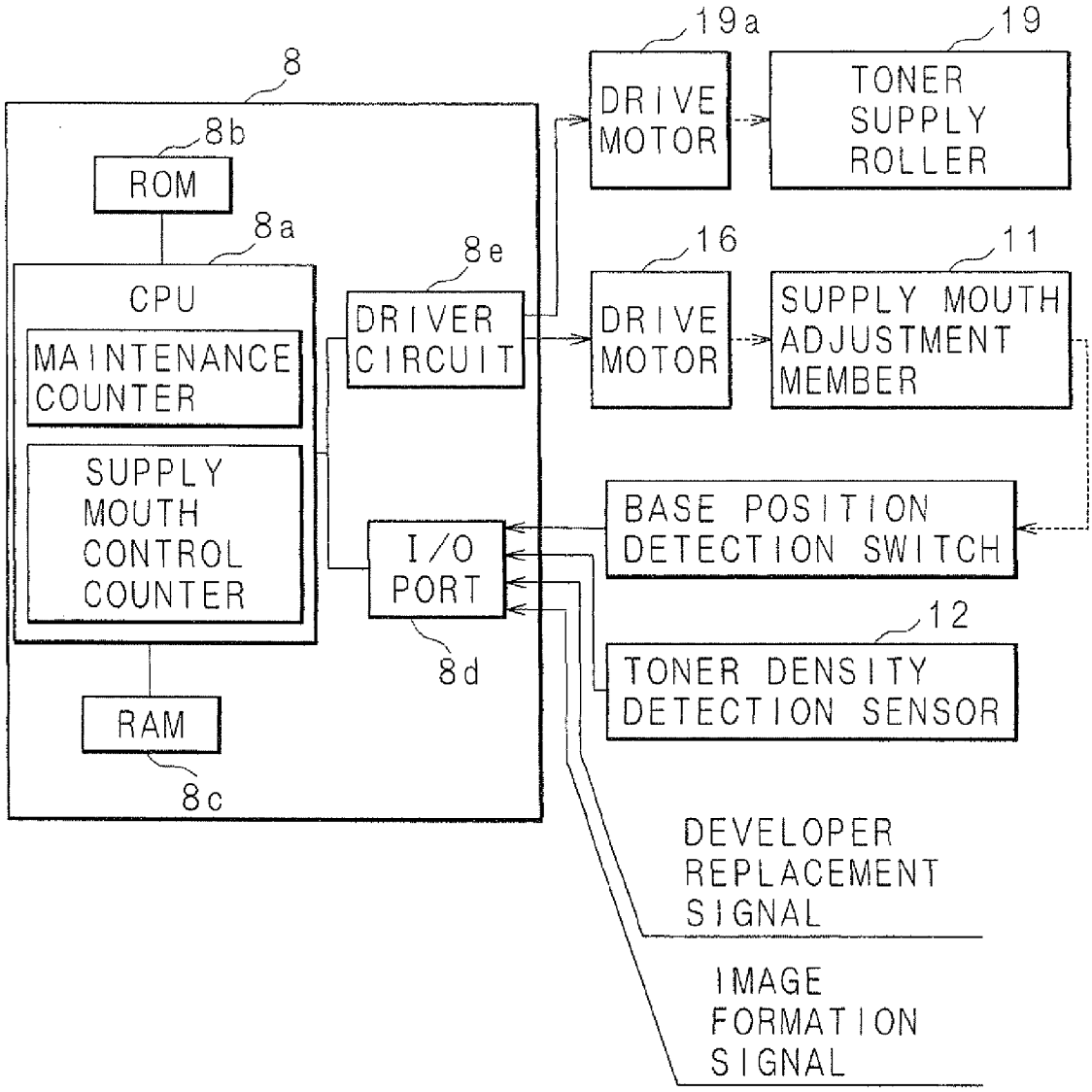
FIG. 8 is a block diagram showing the structure around a control unit according to a first embodiment.

FIG. 8 is a block diagram showing the structure around a control unit 8 according to the first embodiment. While a control unit that controls the entire image forming apparatus may be used as the control unit 8, FIG. 8 shows one used exclusively for the development device 1. The control unit 8 is a microcomputer including: a CPU (central processing unit) 8*a* that performs computations such as various detections and determinations; a ROM 8*b* that stores control programs for the computations performed by the CPU 8*a*, various set values and the like; a RAM 8*c* that provides the work area for the computations performed by the CPU 8*a*; an I/O port 8*d* that performs input and output of control signals with various sensors provided in the development device 1 under the control of the CPU 8*a*; and a driver circuit 8*e* that drives various drive motors provided in the development device 1 under the control of the CPU 8*a*.

To the I/O port 8*d* of the control unit 8, the following signals are inputted: a detection signal of the toner density detection sensor 12; a signal of a base position detection switch detecting that the supply mouth adjustment member 11 is situated in a base position (position where the area of the opening of the developer supply mouth 13 is minimum); a developer replacement signal from a non-illustrated switch operated when the two-component developer in the development tank 2 is replaced with new developer, or the like; and an image formation signal of each printing (copying or printing) onto one recording medium from a non-illustrated control device controlling the entire image forming apparatus. The CPU 8*a* has a maintenance counter storing the number of times of printing and a supply mouth control counter used for controlling the supply mouth adjustment member 11. The driver circuit 8*e* of the control unit 8 is connected to a drive motor 19*a* that rotates the toner supply roller 19 and the drive motor 16 that moves the supply mouth adjustment member 11.

When determining that the toner density in the development tank 2 is lower than the set value based on the detection result by the toner density detection sensor 12, the control unit 8 sends a control signal to the drive motor 19*a* to rotate the toner supply roller 19.

Figure 9:
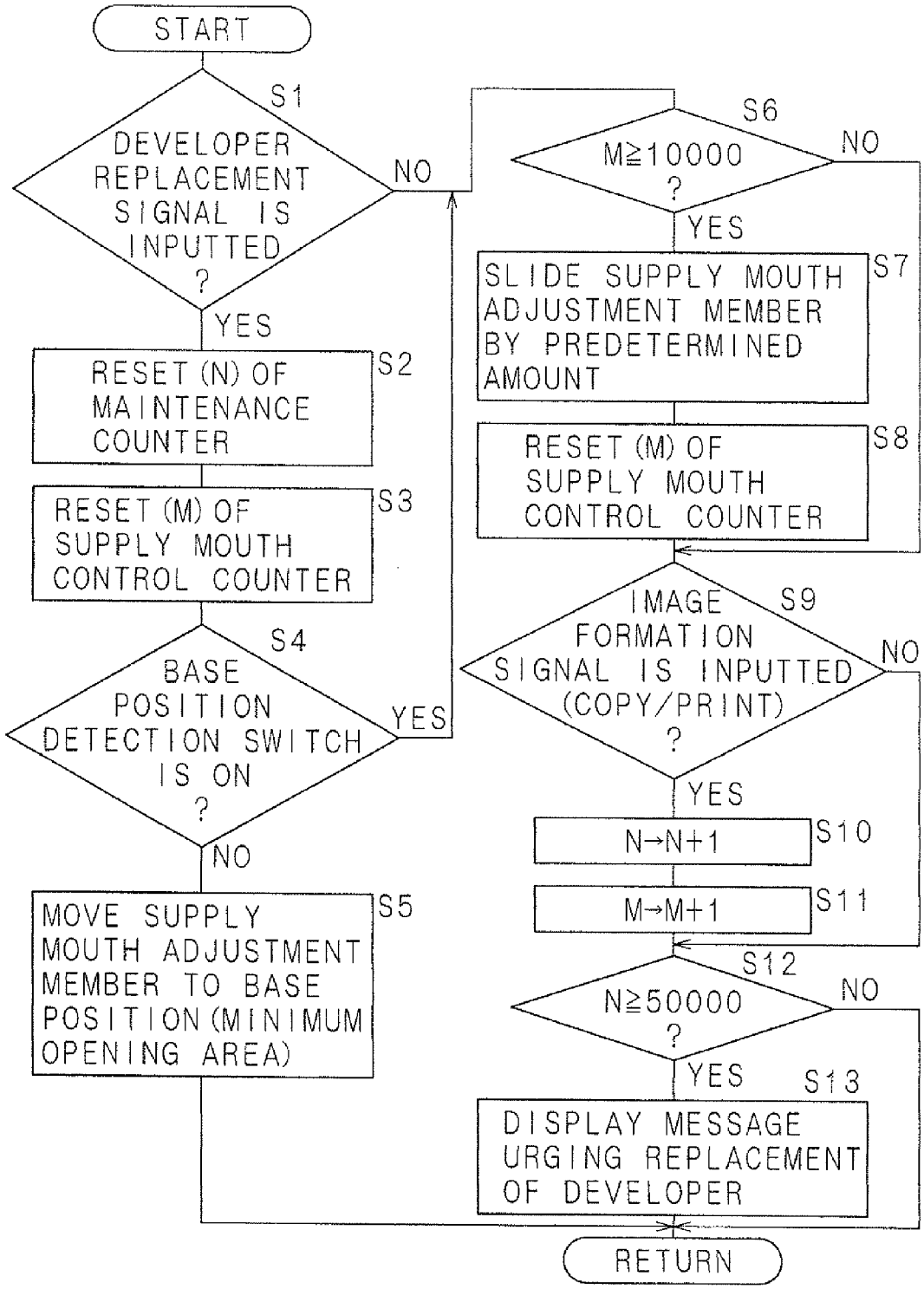
FIG. 9 is a flowchart showing the procedure of control by the control unit according to the first embodiment.

Next, the control of conveyance of the developer in the development tank 2 will be described. FIG. 9 is a flowchart showing the procedure of the control by the CPU 8*a* of the control unit 8 according to the first embodiment.

First, whether the developer replacement signal is inputted or not is determined (step S1). When the developer replacement signal is inputted (step S1: YES), the count value (N) of the maintenance counter and the count value (M) of the supply mouth control counter are reset (steps S2 and S3). When the base position detection switch is not on (step S4: NO), a drive signal is outputted to the drive motor 16 so as to move the supply mouth adjustment member 11 to the base position (step S5), and then, the process ends. When the base position detection switch is on (step S4: YES) and when the developer replacement signal is not inputted (step S1: NO), the process shifts to step S6.

At step S6, it is determined whether or not the count value (M) of the supply mouth control counter reaches a set value (for example, 10000 times) for adjusting the area of the opening of the supply mouth adjustment member 11. When the count value (M) reaches the set value (step S6: YES), a drive signal is outputted to the drive motor 16 so as to increase the area of the opening of the supply mouth adjustment member 11 by a predetermined amount, and the count value (M) of the supply mouth control counter is reset (steps S7 and S8). Then, the process shifts to step S9. When the count value (M) of the supply mouth control counter does not reach the set value for adjusting the area of the opening of the supply mouth adjustment member 11 (step S6: NO), the process shifts to step S9.

At step S9, whether the image formation signal is inputted or not is determined. When the image formation signal is inputted (step S9: YES), the count value (N) of the maintenance counter and the count value (M) of the supply mouth control counter are both incremented by 1 (steps S10 and S11), and then, the process shifts to step S12. When the image formation signal is not inputted (step S9: NO), the process shifts to step S12.

At step S12, it is determined whether or not the count value (N) of the maintenance counter reaches a set value (for example, 50000 times) indicating the end of the life of the developer. When the count value (N) reaches the set value (step S12: YES), a signal to display a message urging the replacement of the developer (serviceman call) on a non-illustrated display is outputted to the non-illustrated control device controlling the entire image forming apparatus (step S13), and then, the process ends. When the count value (N) of the maintenance counter does not reach the set value indicating the end of the life of the developer (step S12: NO), the process ends without any further processing being performed. Thereafter, the procedure of the developer conveyance control operation is repetitively performed at a predetermined timing.

Next, a second embodiment will be described. The second embodiment is different from the first embodiment in that, of the characteristics of the two-component developer, fluidity is directly detected and the area of the opening of the supply mouth adjustment member 11 is adjusted based on the detection result. The structures other than that are similar to those of the first embodiment.

Figure 10:
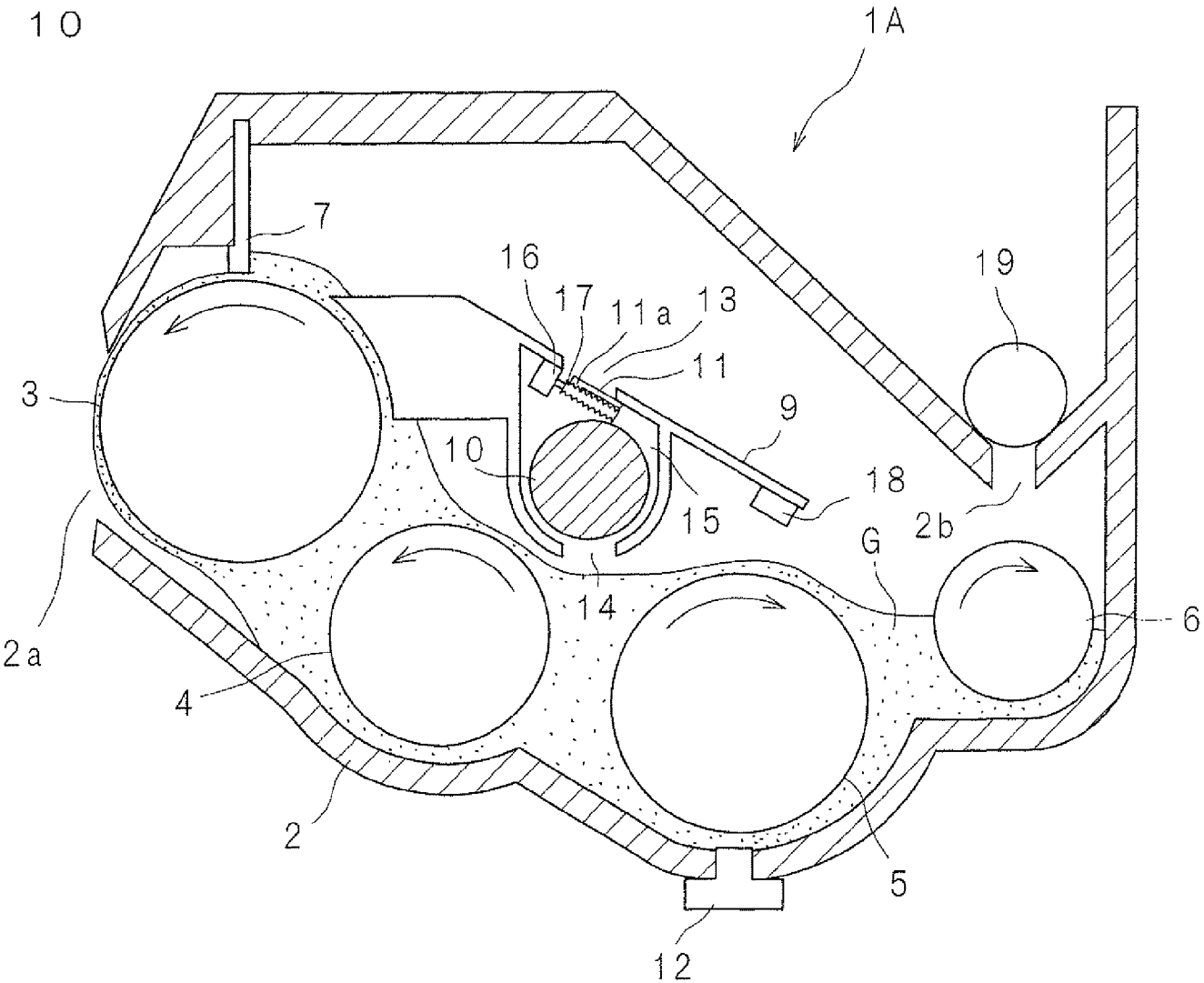
FIG. 10 is a front cross-sectional view showing the structure of a development device according to a second embodiment.
Figure 11:
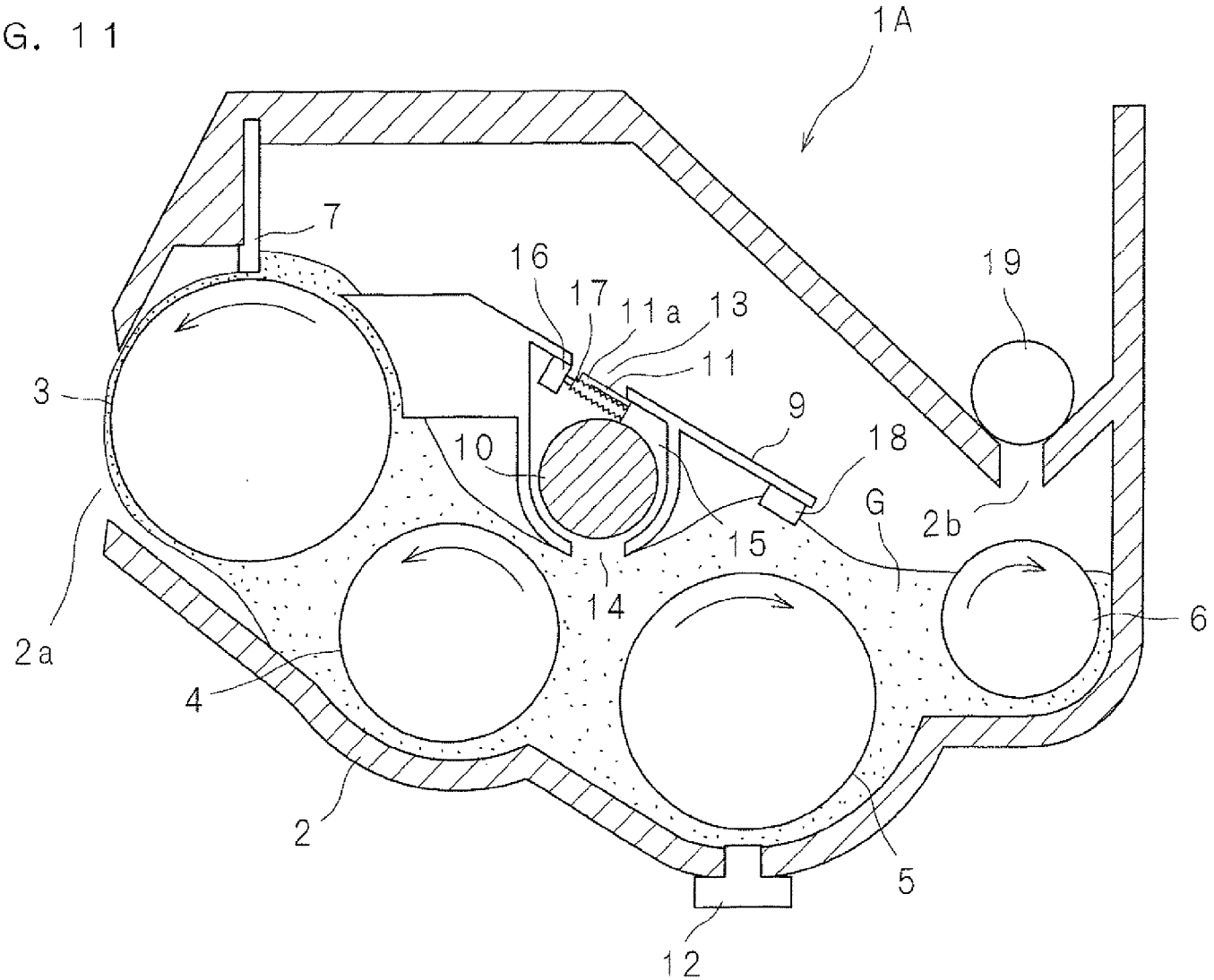
FIG. 11 is a front cross-sectional view showing the structure of the development device according to the second embodiment.

FIGS. 10 and 11 are front cross-sectional views showing the structure of a development device 1A according to the second embodiment. A piezoelectric sensor 18 is attached to the bottom surface, on the end opposite to the development roller 3, of the flow plate 9. When the fluidity of a two-component developer G is high (excellent), since the two-component developer G is smoothly conveyed in the development tank 2, it is not very high in bulk and does not touch the piezoelectric sensor 18 (the condition of FIG. 10). When the fluidity of the two-component developer G is low (inferior), the two-component developer G is high in bulk in the development tank 2 and touches the piezoelectric sensor 18 (the condition of FIG. 11). Since the detection signal of the piezoelectric sensor 18 differs between the condition where the two-component developer G touches and the condition where it does not touch, whether the fluidity of the two-component developer G is high or low can be detected by the piezoelectric sensor 18. It is assumed that the detection signal of the piezoelectric sensor 18 is on when the two-component developer G touches and the detection signal of the piezoelectric sensor 18 is off when it does not touch.

Figure 12:
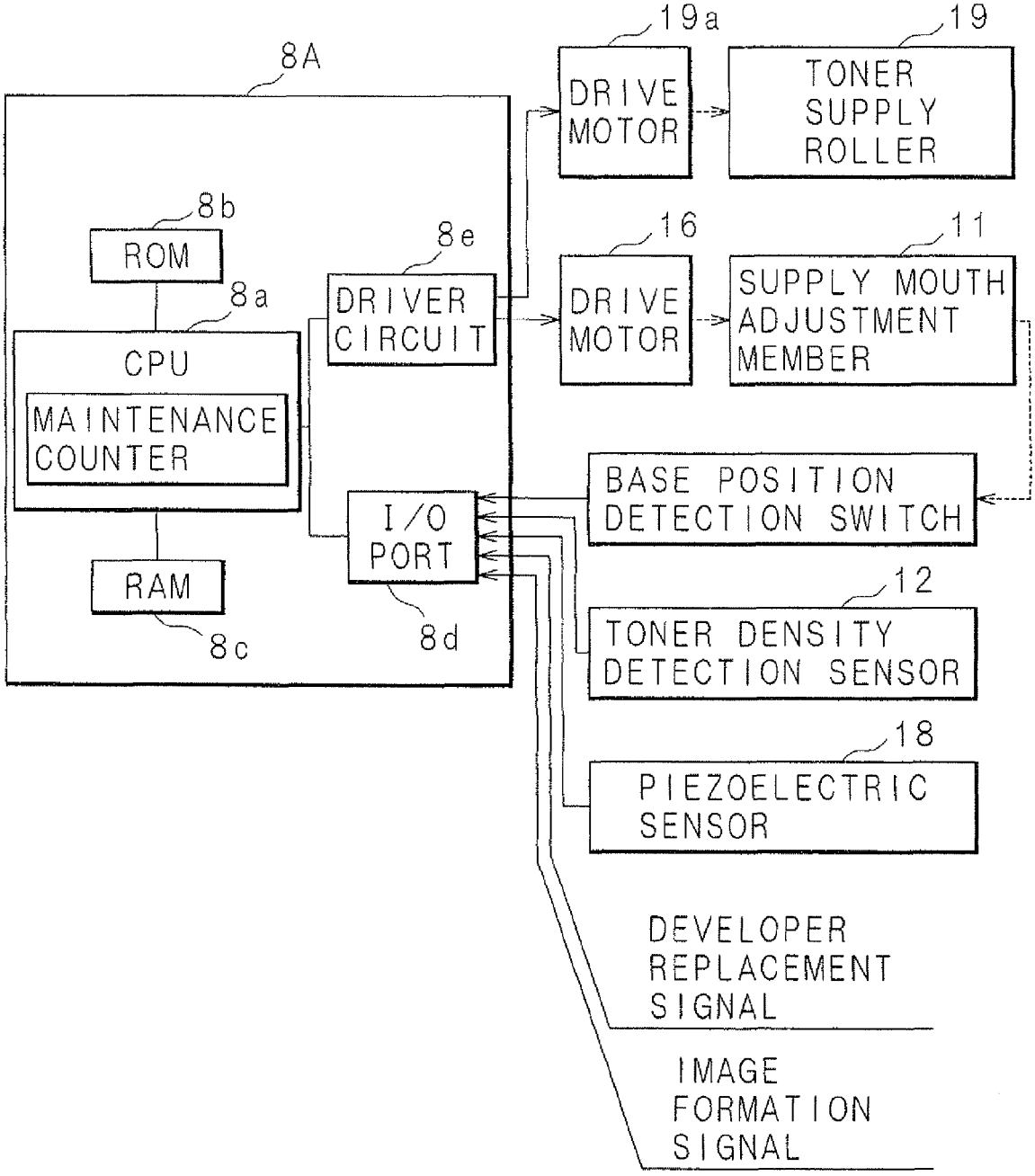
FIG. 12 is a block diagram showing the structure around a control unit according to the second embodiment.

FIG. 12 is a block diagram showing the structure around a control unit 8A according to the second embodiment. The control unit 8A is different from the control unit 8 according to the first embodiment in that the detection signal of the piezoelectric sensor 18 is inputted to the I/O port 8*d*. The structures other than that are similar to those of the first embodiment. Moreover, the control unit 8A is different in that no supply mouth control counter is structured in the CPU 8*a*.

Figure 13:
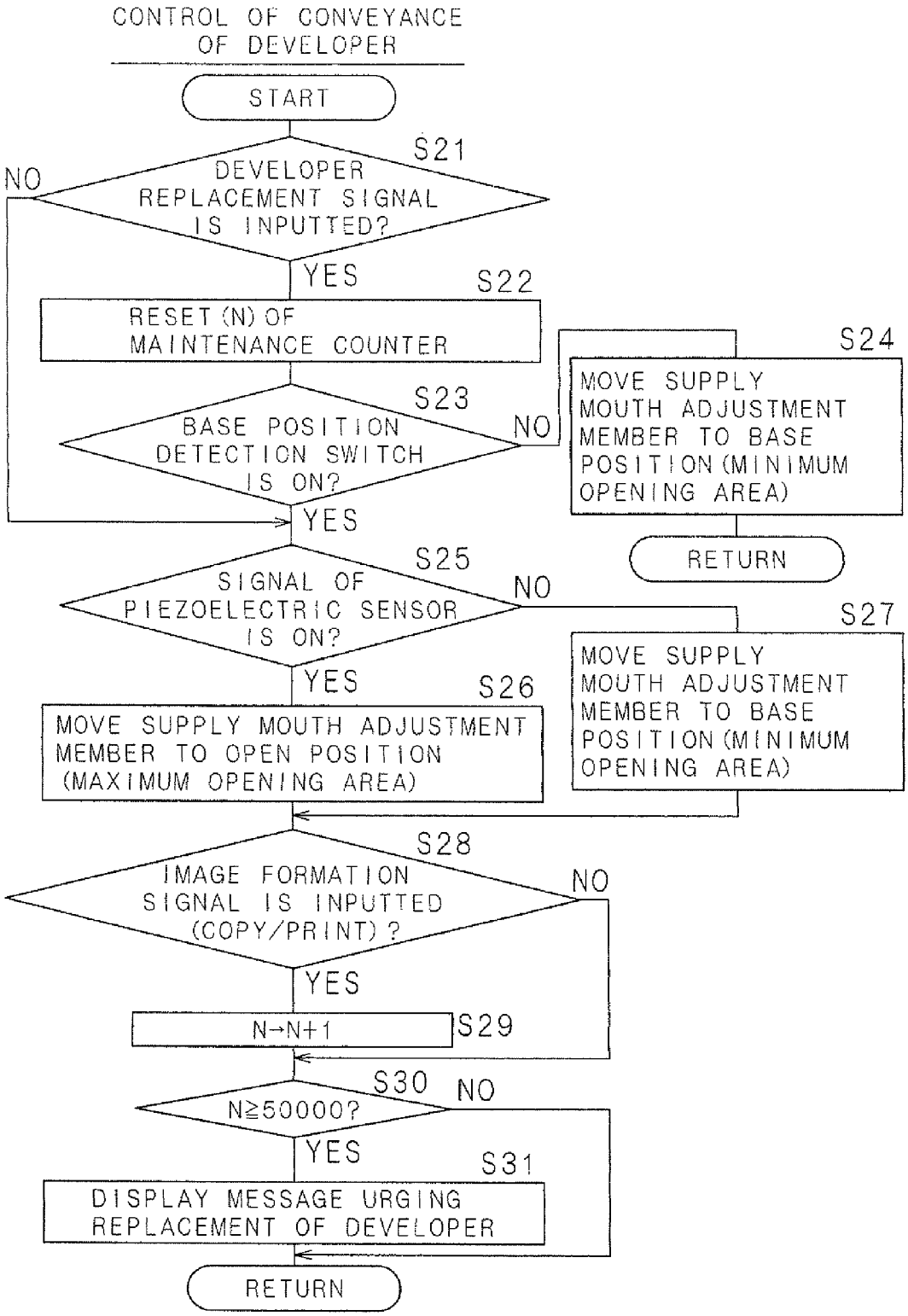
FIG. 13 is a flowchart showing the procedure of control by the control unit according to the second embodiment.

Next, the control of conveyance of the developer in the development tank 2 in the second embodiment will be described. FIG. 13 is a flowchart showing the procedure of control by the CPU 8*a* of the control unit 8A according to the second embodiment.

First, whether the developer replacement signal is inputted or not is determined (step S21). When the developer replacement signal is inputted (step S21: YES), the count value (N) of the maintenance counter is reset (step S22). When the base position detection switch is not on (step S23: NO), a drive signal is outputted to the drive motor 16 so as to move the supply mouth adjustment member 11 to the base position (step S24), and then, the process ends. When the base position detection switch is on (step S23: YES) and when the developer replacement signal is not inputted (step S21: NO), the process shifts to step S25.

At step S25, it is determined whether the two-component developer touches the piezoelectric sensor 18 or not (whether the signal of the piezoelectric sensor 18 is on or not). When the signal of the piezoelectric sensor 18 is on (step S25: YES), a drive signal is outputted to the drive motor 16 so that the area of the opening of the supply mouth adjustment member 11 is maximum (step S26). When the signal of the piezoelectric sensor 18 is not on (step S25: NO), a drive signal is outputted to the drive motor 16 so that the area of the opening of the supply mouth adjustment member 11 is minimum (step S27). Then, the process shifts to step S28.

At step S28, whether the image formation signal is inputted or not is determined. When the image formation signal is inputted (step S28: YES), the count value (N) of the maintenance counter is incremented by 1 (step S29), and then, the process shifts to step S30. When the image formation signal is not inputted (step S28: NO), the process shifts to step S30.

At step S30, it is determined whether or not the count value (N) of the maintenance counter reaches a set value (for example, 50000 times) indicating the end of the life of the developer. When the count value (N) reaches the set value (step S30: YES), a signal to display a message urging the replacement of the developer (serviceman call) on a non-illustrated display is outputted to the non-illustrated control device controlling the entire image forming apparatus (step S31), and then, the process ends. When the count value (N) of the maintenance counter does not reach the set value indicating the end of the life of the developer (step S30: NO), the process ends without any further processing being performed. Thereafter, the procedure of the developer conveyance control operation is repetitively performed at a predetermined timing.

Next, another embodiment of the development device will be described.

While in the first embodiment, the cumulative use time of the two-component developer is determined based on the number of times of printing onto recording media (the number of times the electrostatic latent image on the photoconductor drum 20 is developed), the actual time during which the two-component developer is stirred and conveyed in the development tank 2 (the operating times of the development roller 3 and the stirring members 4, 5 and 6) may be directly measured by a timer or the like.

While in the second embodiment, the area of the opening of the supply mouth adjustment member 11 is adjusted based on the detection result of the fluidity of the two-component developer in the development tank 2, the area of the opening of the supply mouth adjustment member 11 may be adjusted based on the detection information such as another characteristic (for example, the electrification characteristic or the electric resistance) of the two-component developer in the development tank 2. While in the second embodiment, the fluidity of the two-component developer is detected as two values of high and low and the area of the opening of the supply mouth adjustment member 11 is adjusted in two steps of maximum and minimum, the fluidity of the two-component developer may be more finely detected so that the area of the opening of the supply mouth adjustment member 11 is adjusted in three or more steps.

As this technology may be embodied in several forms without departing from the spirit of essential characteristics thereof, the present embodiment is therefore illustrative and not restrictive, since the scope of the technology is defined by the appended claims rather than by the description preceding them, and all changes that fall within metes and bounds of the claims, or equivalence of such metes and bounds thereof are therefore intended to be embraced by the claims.

What is claimed is:

1. A development device, comprising:

a development roller that rotates while carrying a two-component developer in a development tank accommodating the two-component developer;

a tubular developer conveyance path having therein a conveyance mechanism that conveys the two-component developer in an axial direction of the development roller;

a developer supply mouth for supplying the two-component developer to the developer conveyance path;

a developer discharge mouth for discharging the two-component developer from the developer conveyance path;

a supply mouth adjustment member that adjusts an area of an opening of the developer supply mouth; and a control unit that causes the supply mouth adjustment member to operate based on information on the two-component developer in the development tank, wherein the control unit increases the area of the opening of the developer supply mouth as a cumulative use time of the two-component developer increases.

2. The development device according to claim 1, wherein the control unit determines the cumulative use time of the two-component developer based on the number of times an electrostatic latent image on a latent image carrier is developed.

3. The development device according to claim 1, further comprising a detection unit that detects a fluidity of the two-component developer in the development tank, wherein the control unit also controls the area of the opening of the developer supply mouth based on the fluidity of the two-component developer detected by the detection unit.

4. The development device according to claim 3, wherein when the fluidity of the two-component developer detected by the detection unit is higher than a predetermined level, the control unit decreases the area of the opening of the developer supply mouth.

5. The development device according to claim 3, wherein when the fluidity of the two-component developer detected by the detection unit is lower than a predetermined level, the control unit increases the area of the opening of the developer supply mouth.

6. The development device according to claim 1, wherein the developer supply mouth and the developer discharge mouth are provided at opposite ends of the conveyance path in the axial direction of the development roller.

7. The development device according to claim 1, wherein a restricting member that restricts an amount of two-component developer carried by the development roller and a flow plate that lets an excessive two-component developer restricted by the restricting member flow in a direction away from a peripheral surface of the development roller are provided in the development tank, wherein the developer conveyance path is provided on a bottom side of the flow plate, and wherein the developer supply mouth is formed on the flow plate.

8. A development device, comprising:

a development roller that rotates while carrying a two-component developer in a development tank accommodating the two-component developer;

a tubular developer conveyance path having therein a conveyance mechanism that conveys the two-component developer in an axial direction of the development roller;

a developer supply mouth for supplying the two-component developer to the developer conveyance path;

a developer discharge mouth for discharging the two-component developer from the developer conveyance path;

a supply mouth adjustment member that adjusts an area of an opening of the developer supply mouth;

a control unit that causes the supply mouth adjustment member to operate based on information on the two-component developer in the development tank; and a detection unit that detects a fluidity of the two-component developer in the development tank, wherein the control unit controls the area of the opening of the developer supply mouth based on the fluidity of the two-component developer detected by the detection unit.

9. The development device according to claim 8, wherein when the fluidity of the two-component developer detected by the detection unit is higher than a predetermined level, the control unit decreases the area of the opening of the developer supply mouth.

10. The development device according to claim 8, wherein when the fluidity of the two-component developer detected by the detection unit is lower than a predetermined level, the control unit increases the area of the opening of the developer supply mouth.

11. The development device according to claim 8, wherein the developer supply mouth and the developer discharge mouth are provided at opposite ends of the conveyance path in the axial direction of the development roller.

12. The development device according to claim 8, wherein a restricting member that restricts an amount of two-component developer carried by the development roller and a flow plate that lets an excessive two-component developer restricted by the restricting member flow in a direction away from a peripheral surface of the development roller are provided in the development tank, wherein the developer conveyance path is provided on a bottom side of the flow plate, and wherein the developer supply mouth is formed on the flow plate.

* * * * *